US006310562B1

(12) United States Patent
Safronov et al.

(10) Patent No.: US 6,310,562 B1
(45) Date of Patent: Oct. 30, 2001

(54) METHOD OF INDICATING TIME REMAINING UNTIL TRAFFIC LIGHTS CHANGE

(76) Inventors: Mikhail Fedorovich Safronov, Russian Federation, 107120, Moscow, ul.Nizhnaya Syromyatnicheskaya, d. 5, kv. 57; Vyacheslav Emelyanovich Bartenev, Russian Federation, 107120, Moscow, ul. Nizhnaya Syromyatnicheskaya, d. 5, kv. 52, both of Moscow, Russian Federation (RU)

( * ) Notice: Subject to any disclaimer, the term of this patent is extended or adjusted under 35 U.S.C. 154(b) by 0 days.

(21) Appl. No.: 09/117,864

(22) PCT Filed: Apr. 26, 1996

(86) PCT No.: PCT/RU96/00105

§ 371 Date: Aug. 6, 1998

§ 102(e) Date: Aug. 6, 1998

(87) PCT Pub. No.: WO97/29469

PCT Pub. Date: Aug. 14, 1997

(30) Foreign Application Priority Data

Feb. 7, 1996 (RU) ..... 96101959

(51) Int. Cl.[7] ..... G08G 1/096

(52) U.S. Cl. ..... 340/929; 340/907; 340/309.15; 340/309.4; 340/331; 340/332

(58) Field of Search ..... 340/929, 907, 340/309.15, 309.9, 309.3, 331, 332

(56) References Cited

U.S. PATENT DOCUMENTS

| | | | | |
|---|---|---|---|---|
| 3,408,623 | | 10/1968 | Wagner | 340/929 |
| 4,200,860 | | 4/1980 | Fritzinger | 340/929 |
| 4,827,258 | * | 5/1989 | Evans | 340/929 |

FOREIGN PATENT DOCUMENTS

| | | |
|---|---|---|
| 855064 | 11/1952 | (DE) . |
| A1 3106804 | 9/1982 | (DE) . |
| A1 2572206 | 4/1986 | (FR) . |

* cited by examiner

*Primary Examiner*—Daryl Pope
(74) *Attorney, Agent, or Firm*—Hardaway/Mann IP Group; Nexsen Pruet Jacobs & Pollard, LLP

(57) ABSTRACT

The essence of the method resides in that an optical signalling is carried out to display the remainder on time of three green or red lights which are suspended over a roadway in a single horizontal row on both sides of the orange light. Then two lights of the effective color are alternately switched off at a preset time interval, beginning with the light most removed from the orange lamp, this being done from a preset instant of time till switching on the orange light, while the third light of the effective color remaining switched on for some period of time. Next two switched off lights are switched on again, and the lights are flashing for the remaining period of time in the following sequence: first all the three lights are flashing in synchronism, then two lights and one light, respectively, flash at regular time intervals, after which the orange light goes on.

5 Claims, 2 Drawing Sheets

METHOD OF INDICATING TIME REMAINING UNTIL TRAFFIC LIGHTS CHANGE

TECHNICAL FIELD

The present invention relates in general to light signalling systems and more specifically to a method of indicating the remainder time till a change in the traffic light signal.

BACKGROUND ART

To prevent numerous road accidents resulting from the fact that the driver of a transport vehicle has no precise indication of a an instant of time when the traffic light signal is changed, use is now made of diverse visual methods of indicating vehicle drivers of the time at his/her disposal for passing a crossroad or a pedestrian crosswalk. Indication of the remainder time is effected in the heretofore-known methods with the use of additional indicating elements which can be viewed by the driver simultaneously with the main traffic light signals (i.e., green, red, and orange). Used as such elements are symbols, arrows, numbers (DE Patent A NN 4,210,996, 3,929,342), luminous dots located either in line or round a circle and adapted till successively go out in a direction towards the main indication signal light (FR Patent A N 2,691,566; CH Patent A N 678,668), additional signal lamps of any color arranged in diverse ways with respect to the main signal lights and are turned on one after another at regular intervals which are in fact fractions of a lighting period of a main signal lamp, that is, green or red (FR Patent A N 2,126,134), timers counting down time (in seconds) within which one or the other signal lamp will be on (GB Patent A N 2,248,136).

However, use of additional indication elements is in a majority of cases inconvenient for drivers, because they are to keep watch simultaneously on two or more light signals carrying diverse information. Additional signal lamps (especially when a plurality of such lamps are used) arranged at various places with respect to the main signal lamps both vertically and horizontally, are out of drivers' field of vision, especially those of motor cars which are spaced 10–15 m away from the traffic light.

The technical solution closest to the herein-proposed one is a method of indicating the remainder time till a change in the traffic light signal (U.S. Pat. No. 200,860, wherein a change in the effective signal light is preceded by the red or green lamp starting flashing at variable-length intervals between flashes to inform about a change in the traffic light signal that is to come.

When the effective traffic signal lamp flashes at a final stage more than twice, this might misinform vehicle drivers, because they cannot accurately determine the instant when the signal light is changed; however, any misinformation in traffic signalling might result in unpredictable emergency after-effects. When a driver approaches the crossroad while, e.g., a green light is flashing, he/she has no prior knowledge of how much time remains before a change of the green light for the orange one. Thus, the information boils down to the sole fact that a change in the signal light is next to come. This compels a driver either to increase the speed in order to pass the crossroad before the "go" (green) signal is changed for the "no go" signal, or conversely to reduce the speed. In any of said cases this results either in overspeed or in a traffic jam and a danger of emergency situation occurs.

DISCLOSURE OF THE INVENTION

The present invention has for its principal object to provide a method of indicating the remainder time till a change in the traffic light signal in order to furnish both vehicle drivers and pedestrians with visual information readily perceptible and visible from every point on the roadway within the traffic light visual zone, which is attainable due to appropriately selected number of traffic signal lamps and an interval of their flashing.

The foregoing object is accomplished due to the fact that in a method of indicating the remainder time till a change in the traffic light signal, an optical signalling is established for the traffic participants, which indicates the remainder effective (on) time of the green ("go") or red ("no go") signal light till the orange signal light goes on, said signalling being effected due to short-interval flashing of said light, according to the invention, use is made of further two green and two red signal lights which are suspended, together with the main signal lights, over the roadway in a single row on both sides of the orange light; the flashing mode of all the three lights of the effective color is preceded by switching over the lights of the effective color performed from a preset instant of time till the orange light goes on by alternately switching off, at a preset time interval, two lights beginning with the one most removed from the orange signal light; some period of time following switching off said two lights the third light closest to the orange light remains switched on, whereupon two switched off lights are switched on again; thereafter the lights are flashing for the remaining period of time in the following sequence: first all the three lights are flashing in synchronism, then two lights and one light, respectively, flash at regular time intervals, after which the orange light goes on.

It is expedient that switching over the lights of the effective color starts 20 s before switching on the orange light with a 20-s interval between switching off both lights, that the on time of the third light is 4 s, and that said lights flash for 6 s with a 2-s interval between flashing of the lights of different groups.

A change in the operating mode of the three lights of the effective color 20 s before a change over of a signal provides for normal visibility of signals under any weather conditions and at any time at a distance of 300–400 m from the traffic light. It is at said distance from the traffic light that the driver needs information about the oncoming change of a signal light, proceeding from which information the driver decides whether or not there is enough time for him to pass the crossroad or pedestrian crosswalk with the green light on. With the red light going on, the driver, while being at the same distance from the traffic light and proceeding from the effective time of said signal, can adjust the vehicle speed so as to get at the crossroad a shorter distance thereto at the instant when the green light goes on. It is the final stage of the traffic light operation, i.e., the flashing mode lasting a few (6) seconds that plays a decisive part in the information about the remainder time till a change in the light signal. Said mode begins with simultaneous flashing of the three green or red lights at once which cannot escape notice of even a most careless driver. The entire period of time when the green or red light is on, is accompanied by displaying the information on the current operating time of a given signal, thereby providing the traffic participants with a continuous, reliable and exact information about the effective time of the signals. Each of the operating stages of a signal has time limits of its own. Various combinations of signals of the same color have no identical repeats from the beginning to the end of the effective time of a given signal to avoid misinformation, while such repeats in the flashing mode are avoided due to the number of effective signal lights.

BRIEF DESCRIPTION OF THE DRAWINGS

This invention will be explained in greater detail by an exemplary embodiment, making reference to the drawings, wherein.

BEST METHOD OF CARRYING OUT THE INVENTION

Figure 1:
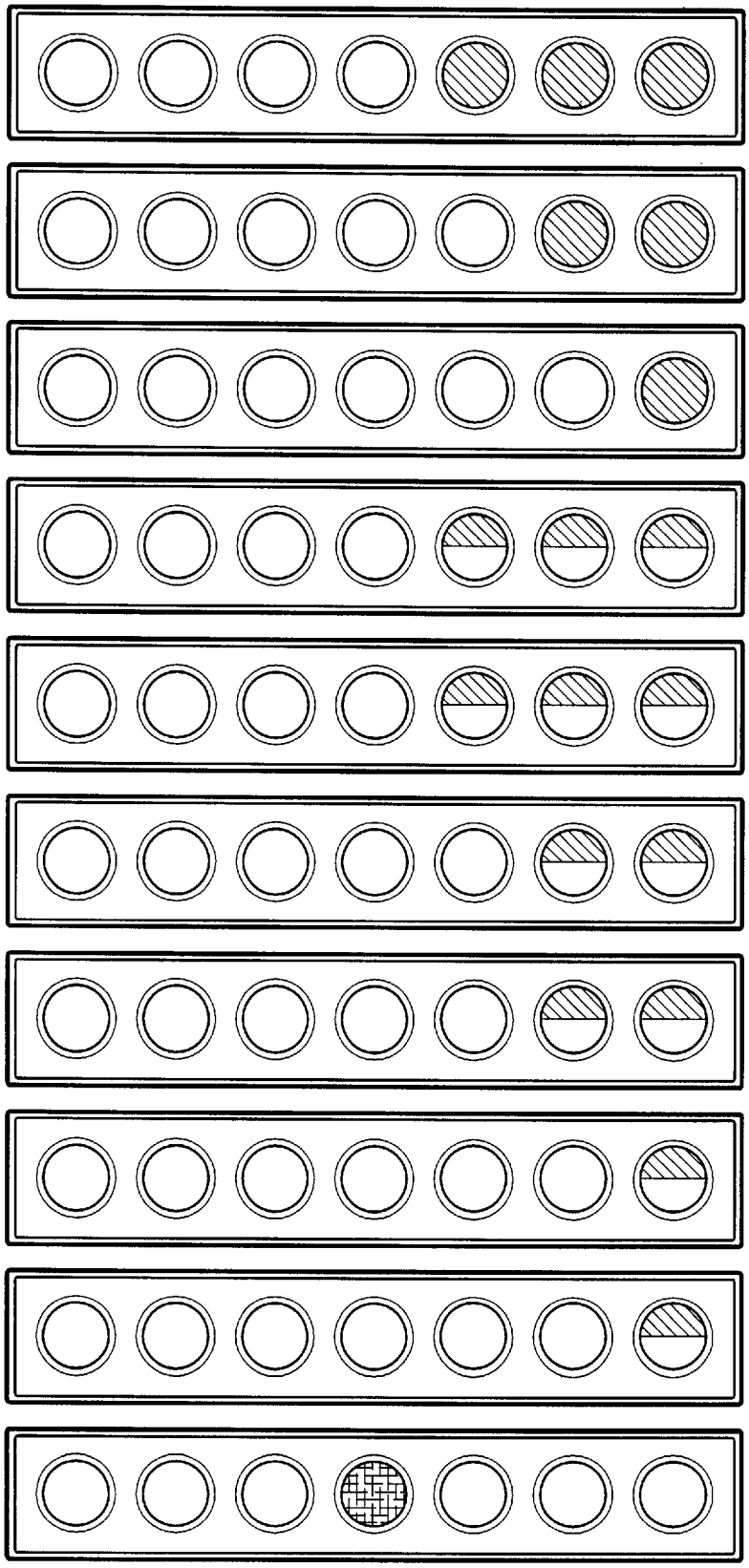
FIGS. 1–2 shows optical signaling lights which alternately switch on and off and as well display colors in a manner which indicates periods of time remaining until a traffic signal light will change.
Figure 2:
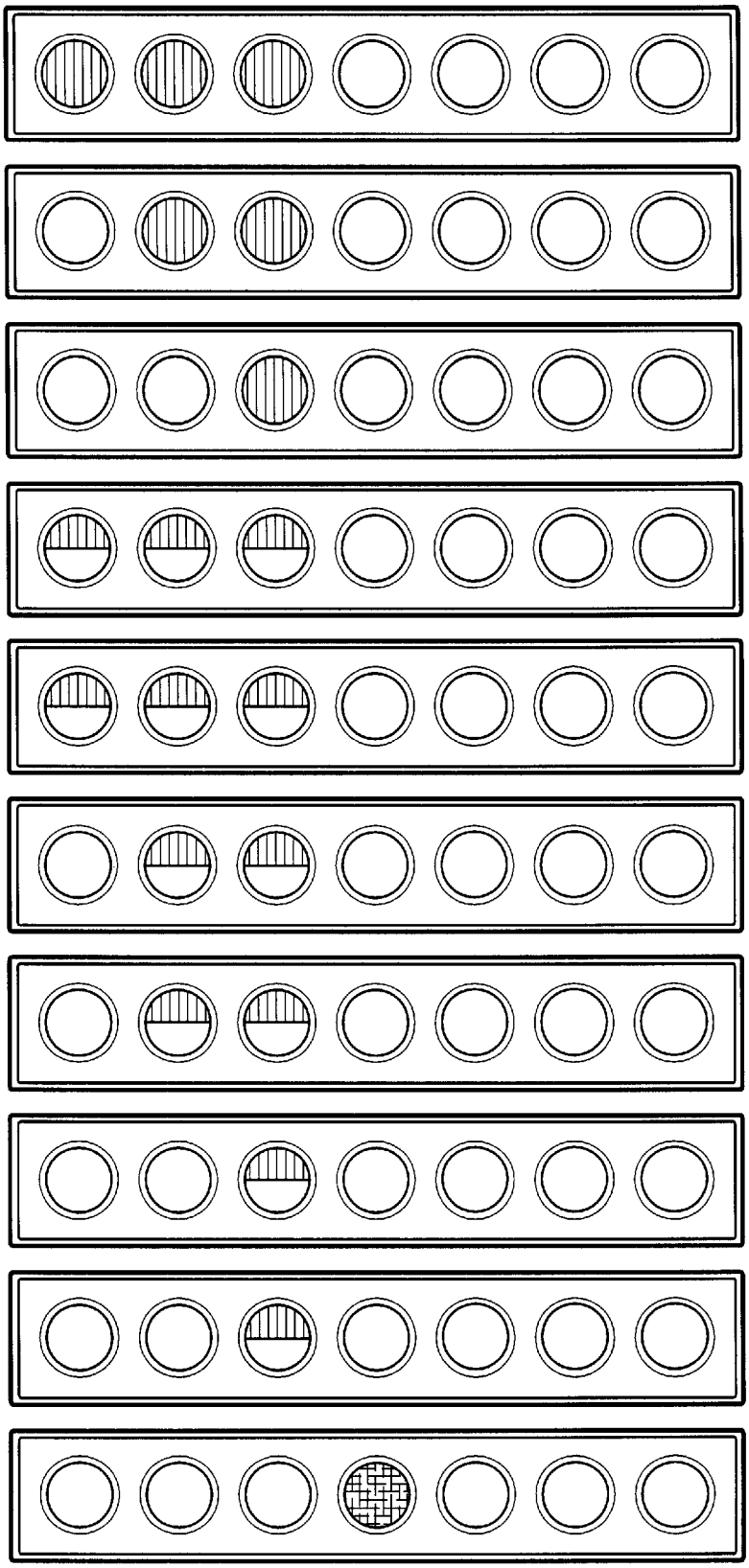

The herein-proposed method of indicating the remainder time till a change in the traffic light signal is carried into effect as follows as shown in FIGS. 1 and 2.

When the orange signal is changed over for, e.g., the green one all the three lights of said color are switched on at a time. Two additional signals, apart from improving visibility, perform the function of giving time information, which is a principal stimulator of a high-speed passing of a crossroad. The signal is aimed at displaying the amount of a guaranteed period of time remainder, e.g., 20 s till the change of said signal. A period of 20 s of a reserve time provides for a guaranteed unobstructed accident-free passing of a crossroad as far as 300 m therefrom to the driver running at a speed of 60 km/h. In a 20-s lapse of time goes out the light most removed from the orange lamp. A next stage is indicated with two green lights being on and is as a rule several times as short as the first stage (e.g., 10 s). After the second stage has been terminated, the remainder time is 10 s. Then the second light next to the one turned out previously is switched off, which terminates the second stage. The third stage is indicated with a single nonflashing green light which is effective for a lapse of time shorter than the two preceding stages, e.g., 4 s. Hence the remainder time is as short as 6 s. At last there comes the fourth, final stage, that is, flashing mode, which consists in that all the three lights flash for one second in synchronism, then one of the lights goes out and the other two flash in the same rhythm, and finally one light flashes, the other two being switched off. This done, the orange light goes on.

Thus, the herein-proposed method is instrumental in putting at drivers' disposal a full scope of uniform information required for providing accident-free high-speed passing of crossroads, first and foremost, those on heavy-traffic avenues and streets without causing any negative emotions in vehicle drivers. The shape of a traffic light, uniform signals and their small number require less time for a driver to perceive and understand the traffic light indications.

INDUSTRIAL APPLICABILITY

The present invention can find successful application for traffic control of city vehicular transport.

What is claimed is:

1. A method for indicating the time remaining before a change in a signal light comprising:

a) arranging, in order, three green lights, one orange light and three red lights;

b) at a first time period before a change is to be made, tuning off one of a first set of three lights;

c) at a second time period before a change is to be made, turning off a second of the first set of lights;

d) at a third time period before a change is to be made, flashing said first and second lights;

e) at a fourth time period, turning off said three lights of said first set and turning on said orange light; and f) at a fifth time period, turning off said orange light and turning on a second set of three lights of a color different form the first set of lights.

2. A method according to claim 1 further comprising, after said third time period, flashing one of said lights.

3. A method according to claim 1 wherein said first, second and third time periods are the same.

4. A method according to claim 1 wherein said first, second and third time periods are different.

5. A method according to claim 3 wherein the duration of each of said time periods is chosen according to the speed of the vehicles approaching said signal.

* * * * *